United States Patent [19]

Marshall

[11] 4,208,937

[45] Jun. 24, 1980

[54] APPARATUS FOR ACCURATELY CUTTING TIMBERS

[76] Inventor: Lynn Marshall, P.O. Box 26, White Pine, Tenn. 37890

[21] Appl. No.: 943,767

[22] Filed: Sep. 20, 1978

[51] Int. Cl.[2] ..... B27B 17/02

[52] U.S. Cl. ..... 83/799; 83/574

[58] Field of Search ..... 83/574, 799, 798, 797, 83/796, 795, 794; 269/303

[56] References Cited

U.S. PATENT DOCUMENTS

| | | | |
|---|---|---|---|
| 973,258 | 10/1910 | Cannon | 83/798 |
| 2,502,124 | 3/1950 | Bray | 269/303 |
| 2,682,898 | 7/1954 | Le Duc | 83/794 |
| 4,127,046 | 11/1978 | Jackson | 83/798 |

*Primary Examiner*—Robert C. Watson

*Attorney, Agent, or Firm*—James C. Kesterson

[57] ABSTRACT

Apparatus for accurately cutting logs and large timbers at selected angles with a chain saw is disclosed. The invention includes a base framework which works in combination with a support table. The base framework includes vertical rods mounted to the base framework. The bar of the chain saw is secured to guides which slide up and down on the rods. The chain saw and base framework combination are pivotally secured to the support table such that the chain saw blade can be positioned at various angles with respect to the log or other material being cut. Once the angle has been selected, the chain saw and base framework combination are secured to the support table such that the angle at which the logs are cut will remain constant as the saw is operated. One embodiment includes means for counter balancing the chain saw weight to aid in operation of the saw.

7 Claims, 7 Drawing Figures

APPARATUS FOR ACCURATELY CUTTING TIMBERS

BACKGROUND OF THE INVENTION

This invention relates to apparatus for accurately cutting materials at selected angles and more particularly to apparatus which operates in conjunction with a chain saw for accurately cutting materials such as logs and large timbers at selected angles. Interest in some areas of America's heritage, and concern about the excessive energy required to heat homes and structures built according to present day techniques has resulted in a renewed interest in homes and buildings constructed from logs and huge timbers. One reason for this renewed interest is that the insulation value of, for example, a wall made of 8-inch logs is significantly greater than the insulation value of an insulated frame wall on a typical american home. Unfortunately, buildings of the type erected by the early pioneers which used logs and large timbers also are not acceptable because of the cracks and air gaps left between the ill-fitting logs. These primitive walls therefore do not provide the insulation values for which they are capable, since the wind allows cold air to blow into the structure between adjoining logs. It is clear, therefore, that to appreciate the great insulation values of large timbers and logs, it is necessary that the logs or timber fit together such that they are airtight. To this end, modern homes made out of logs are constructed of logs having uniform sizes and mating surfaces. These techniques have been highly successful as far as achieving high insulation values for the basic outside walls of the structure. Unfortunately, because of variations from structure to structure of such buildings, those logs or timbers making up the side walls at the top of the structure which come to a peak as the wall forms the gable typically cannot be cut accurately enough to attach the roof in an air tight manner. These upper side walls are normally put into place in the same manner as the logs making up the rest of the side wall and then an attempt is made to carefully cut through each log or timber at an angle necessary to obtain the gable or slope of the roof. This technique is dangerous, and typically results in an uneven cut or roof pitch, which requires extensive filling of the spaces and gaps left because of such irregular cuts. Other approaches have been to simply not use the large logs or timbers for those portions of the wall forming a roof gable and instead use walls made by standard framing techniques for their upper walls. However, this approach is not as esthetically pleasing nor is it as effective in its insulation qualities as would be a well fitted solid log wall. Therefore, it is an object of this invention to provide apparatus for accurately and precisely cutting logs and large timbers at angles necessary for forming a roof gable.

Because of the large size of the logs and timbers used in modern log house structures, the standard 7 or 8 inch blade "skill" or bench saw typically used at home construction sites is just not suitable for cutting such large timbers. Furthermore, during the construction of such log buildings it is often necessary to make cutouts through solid walls made of such logs or timbers stacked on top of each other. Therefore, chain saws have become a functional and important tool at such construction sites. The chain saw is suitable for such uses because of its portability, its ease of handling and its ability to cut through large diameter timbers by means of a small machine. In the past, chain saws have been used as the primary means for cutting the topmost portion of a log wall at an angle necessary to form a roof gable. However, as was mentioned heretofore, efforts to accurately cut through a solid log wall at the proper angle with a chain saw to form an airtight fit with the roof has been unacceptable and dangerous. In general, chain saws have been around for many years in the logging industry and have been found to be a very versatile tool. Because of this versatility and their light weight, a number of improvements and adaptors which work with chain saws have been developed over the years. As an example, U.S. Pat. No. 1,861,162 issued to H. Quist on May 31, 1932, discloses apparatus for use with a chain saw to aid in cutting piles or other vertical timbers in which the weight of the chain saw must be supported to insure that the cut is made at the desired predetermined angle. According to this patent, this is accomplished by the use of guides rigidly attached to the chain saw which guides engaged battens secured to the pile to be cut. This technique is of course not suitable for cutting walls for structure at an angle because of the danger involved, and because of the need for carefully securing the battens to each of the logs being cut.

U.S. Pat. No. 2,463,860 issued to R. E. Foster on Mar. 8, 1949, discloses apparatus for supporting a large two-main chain saw such that huge timbers or logs may be cut by one person. This device includes a pointed drive member which is driven into the wood or timber at a location close to the position that the desired cut is to be made. Attached to this pointed drive member is an adjustable support arm which is used to engage a hole in the bar of the chain saw. The bar of the chain saw is then pivoted around the support arm to achieve the desired cut.

Another U.S. Pat. No. 2,698,034 issued to E. A. Jakku on Dec. 28, 1954, discloses still another apparatus which is attached to a chain saw. This patent discloses the use of several guards attached at selected location on the bar of the chain saw such that they extend perpendicular to and beyond the cutting portion of the cutting chain. These guards thereby provide a support for twigs and small limbs to bear against during the cutting operations such that the twigs or limbs will be held in place as they are being cut and not be swept into the face of the operator of the chain saw or out of reach of the cutting chain. It is obvious of course that this patent in no way discloses much less teaches apparatus for accurately cutting large timbers or logs with a chain saw.

U.S. Pat. No. 3,225,799 issued to E. A. Hayden et al. on Dec. 28, 1965 discloses chain saw apparatus for ripping logs which can be used at the location at which the felling operation takes place. According to this patent, a large log or timber can be cut lengthwise at the location that the tree is felled. It will be appreciated that although this device does allow logs to be cut by a chain saw into substantially regular size timbers, it in no way teaches a technique for precisely cutting logs and timbers at an angle suitable for use in forming the gable of a log structure.

U.S. Pat. No. 3,845,556 issued to T. H. Edmunson on Nov. 5, 1974, does disclose apparatus for use with a chain saw in cutting timbers at an angle. This device uses a cutting guide such as is used on a "skill" saw or bench saw for cutting timbers at an angle. The guide may also be used in combination with a ripping fence or track for cutting the timbers at certain angles such as would be necessary for the roof gable of a building. However, this apparatus must be securely mounted by large lag bolts to the timber being cut prior to the cut taking place. The use of such lag bolts may, of course, mar the lumber such that it is unsuitable for its intended use. Furthermore, this technique is extremely time consuming, is substantially only suitable for timbers having a square cross section and is not suitable for substantially cylindrically shaped logs. Thus, from the discussions of the above patents it is seen that although several types of apparatus have been developed for use with chain saws, none of these apparatus even suggest much less teach the apparatus of the present invention.

In addition to the apparatus described above, with respect to chain saws, the typical mitre box used in woodworking should be considered during a study of the background of this invention. It will be appreciated, that although the mitre box used in the standard woodworking shop and the device of this invention have similarities, the concept of using a large chain saw rather than a fine tooth hand saw is quite remote. In addition, mitre boxes are typically used for cutting small to medium size work pieces and have not found extensive use in cutting large timbers and especially cutting large cross-sectional logs.

Therefore, it is an object of this invention to provide apparatus for precisely cutting logs and large timbers.

It is still another object of this invention to provide an inexpensive and simple apparatus for precisely cutting logs and large timbers.

To accomplish the above mentioned objects as well as other objects which will become evident from the following drawings and detailed description, the present invention provides apparatus which works in combination with a chain saw for cutting large work pieces or logs at precise angles. The apparatus comprises a support table having guide fences for maintaining a work piece at a selected position. A frame support base having a work surface parallel to the surface of the support table is pivotally mounted to the support table such that the frame support base may be positioned at a selected angle with respect to the guide fences. Support members or vertical rods are secured to the frame support base perpendicularly to the work surface of the support base. Guides or sleeves which are attached to the bar of a chain saw move along these vertical rods. Thus, the chain saw which is securely mounted to the guides can move up and down on the vertical rods as the chain saw blade remains substantially parallel to the work surface. This allows a work piece positioned against the guide fences to be precisely cut at a selected angle.

Accordingly, the above mentioned objects and subsequent description will be more readily understood by reference to the following drawings wherein.

DESCRIPTION OF THE INVENTION

Figure 1:
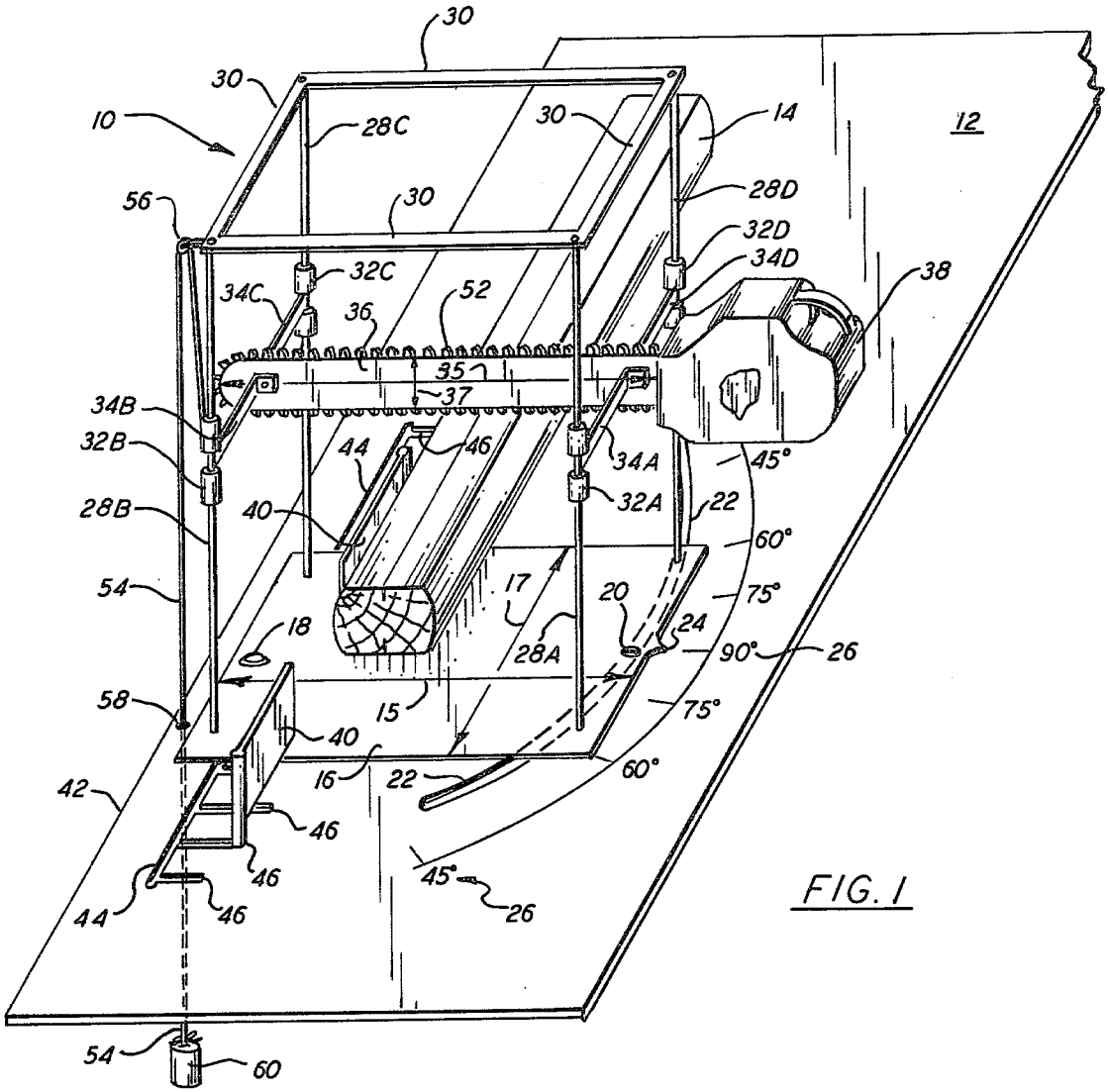
FIG. 1 is an oblique view of an embodiment of this invention showing it in operation for cutting logs.
Figure 2:
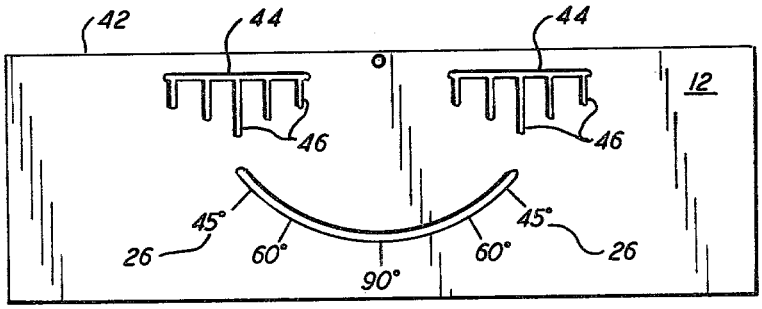
FIG. 2 is a top view of a support table showing grooves for guide fences and the arcuate groove for setting the cutting angle of the saw.
Figure 3:
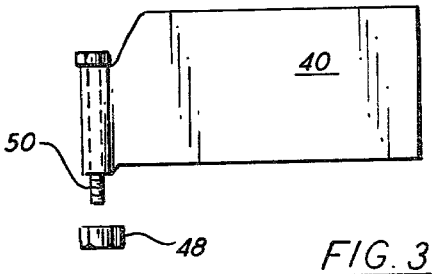
FIG. 3 is an example of a guide fence suitable for use with the support table shown in FIG. 2.

Referring now to FIG. 1 there is shown generally at 10 apparatus of this invention for cutting a log or large timber at a desired angle. According to FIG. 1, the apparatus is set to cut the timber at a 90° or right angle. It will be appreciated that the apparatus could be set to cut the timber or work piece at any desired angle. A support table 12 supports work piece or log 14 which is to be cut. Pivotally mounted to support table 12 is frame support base 16 having a work surface in a plane defined by axis 15 and 17. In the embodiment shown in FIG. 1, frame support base 16 pivots on bolt 18. A securing bolt 20 is mounted at the opposite end of frame support base 16, and slides in arcuate channel 22. A pointer 24 mounted on frame support base 16 is lined up with selected indicia 26 on support table 12 to indicate the angle at which work piece 14 will be cut. Indicia 26 may represent the angle of the cut in degrees as is shown, or it could represent the angle of the cut as the ratio or pitch of the roof (i.e. the upper wall of a building that forms the gable of a roof is cut at an angle to form the roof pitch which pitch may be 3:1, 2:1, 1:1 or any other desired factor). Mounted substantially perpendicular to frame support base 16 are support rods 28A, 28B, 28C and 28D. These support rods 28 may be securely mounted on frame support base 16 such that they stand alone or they may be braced at their top by brace supports such as is shown at 30. Guides 32A, 32B, 32C and 32D fit over their respective support rods 28A, 28B, 28C, and 28D such that they slide smoothly thereon. It will be appreciated by those skilled in the art, that support rods 28 may have a circular cross section such as shown in FIG. 1, or as will become clear in other embodiments described hereinafter, they may have any other desired cross section such as square, triangular, hexagon, etc. It will be appreciated of course that the corresponding guides 32 which slide on the rods must also have a matching cross section. It will further be appreciated, that support rods 28 may be made of any suitable strong material such as steel, iron, etc. However, rods 28 should have a smooth finish to facilitate guides 32 sliding thereon. To this end it may be desirable to include bushings within guides 32 to facilitate the movement of the guides up and down support rods 28. If support rods having a circular cross section are used such as is shown in FIG. 1, it may be desirable even to include bearings within guides 32. Attached to guides 32A, 32B, 32C and 32D are chain saw support braces 34A, 34B, 34C and 34D respectively. Each brace may be attached by bolts and nuts, cast as one integral piece with guides 32 or welded to guides 32. These chain saw support braces 34A through 34D, are securely attached to the bar 36 of chain saw 38. The long axis 35 and short axis 37 of chain saw bar 36 define the cutting plane in which chain saw 38 operates. Chain saw 38 may be any suitable commercially available chain saw, and may be either gasoline powered or electric powered. This chain saw must, of course, have a bar long enough to reach between the necessary support rods and guide brace 34. The chain saw support braces 34 may be attached to the chain saw bar 36 by any suitable means including quick release keys, nuts and bolts, or in some instances could even be welded together. However, to maintain the versatility of the chain saw, so that it can be used independent of this apparatus of this invention, it is suggested that the chain saw bar be releasably attached to chain saw support braces 34. Attached to support table 12, are guide fences 40 against which are positioned the work piece 14. Guide fences 40 are accurately aligned with the length of support table 12 and at a distance from back edge 42 of support table 12 such that work piece 14 is held away from the vertical support rods 28B and 28C to insure on accurate angle cut. Referring now to FIGS. 2 and 3, there is shown one technique for mounting work piece guide fences 40 in the proper position. According to this technique, a groove 44 is cut in support table 12 substantially parallel to the back edge 42 of work table 12. A series of grooves 46 which are perpendicular to and which merge with groove 44 are also cut in support table 12. Each of these perpendicular grooves may have indicating indicia representing the angle at which the desired work piece is to be cut. Thus, to change the position of a section of guide fence 40, nut 48 would be loosened from bolt 50. The combination is then moved within channel 44 to the appropriate perpendicular channel 46 representative of the desired angle at which the work piece is to be cut. Once in place, nut 48 would be secured tightly against support table 12 thereby holding guide fence 40 in the proper position. The same action would of course be required with the companion work fence on the opposite side of the saw blade.

Thus, it can be seen that to operate the device of this invention, securing bolt 20 would be loosened and the frame support base 16 then rotated around pivot bolt 18 until pointer 24 was aligned with the desired angle of cut. Bolt 20 which moves through arcuate channel 22 is then tightly secured to hold frame support base 16 in position. Guide fences 40 would also be positioned to hold the work piece 14 at the necessary distance away from support rods 28. Work piece 14 is then located against guide fences 40 such that as chain saw 38 is precisely lowered along support rods 28, the rapidly moving chain saw blade 52 quickly and precisely cuts through work piece 14 at the desired angle. In some instances, work piece 14 may be used for unusually large logs or timbers. Consequently, chain saw 38 may necessarily also be very large and heavy to accommodate the huge timbers. Under such circumstances, the weight of the chain saw may be difficult to move up and down support rods 28. To this end, there is also shown in FIG. 1 a counterbalance system. For example, as is shown in FIG. 1, attached to guide 32 is a flexible cable 54. Flexible cable 54 runs through pulley 56 which is securely attached to the top of each of support rods 28. Cable 54 then passes through hole 58 in support table 12 to a counterbalancing weight 60. A similar counterbalancing system may be included on each of the support rods 28. Thus, by properly selecting the size and weight of counterbalancing weight 60, chain saw 38 may be easily moved up and down support rods 28. It will be appreciated of course that although a simple counterbalancing technique has been discussed to aid in the explanation of this invention, any suitable and available counterbalancing technique may be employed.

Figure 4:
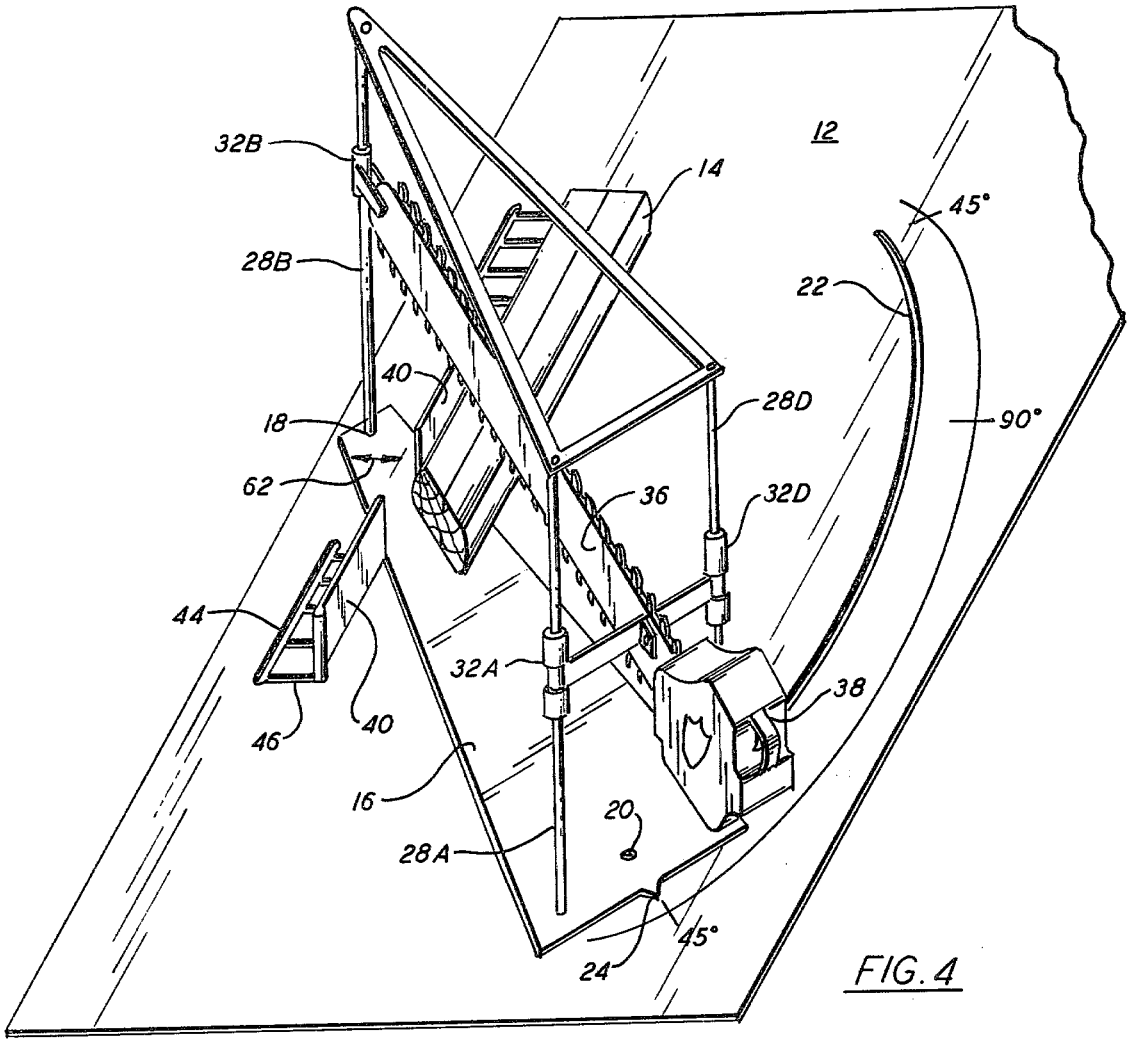
FIG. 4 is an oblique view of another embodiment of this invention.
Figure 5:
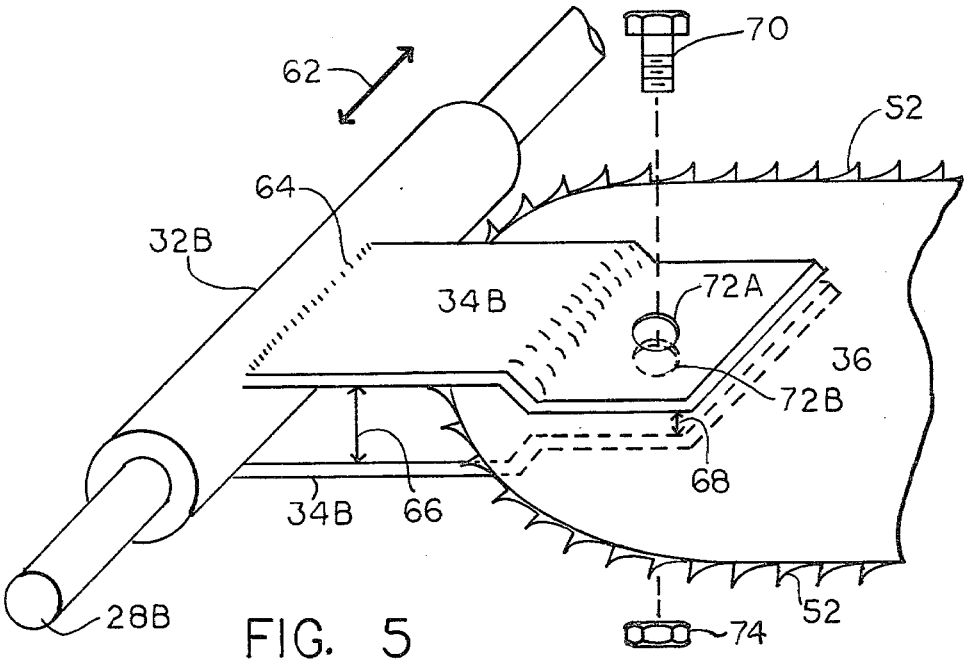
FIGS. 5, 6 and 7 show various techniques for attaching the chain saw bar to the supporting guides of this invention.

Referring now to FIG. 4, there is shown still another embodiment of this invention. This embodiment is similar to that shown in FIG. 1, in that a support table 12 is used to support a work piece 14. Pivotally attached by means of a bolt 18 is a frame support base 16 as was described in FIG. 1. In a similar manner, frame support base 16 would be pivoted around pivot bolt 18 as securing bolt 20 moves through arcuate channel 22. However, unlike the embodiment of FIG. 1, the apparatus of this embodiment is set to cut the work piece or timber 14 at a 45° angle, and includes only 3 support rods, 28A, 28B and 28D. Support rods 28A and 28D along with their corresponding guides 32A and 32D are substantially the same as was discussed with respect to FIG. 1. However, support rod 28B is located substantially in line with the bar of chain saw 38. A single guide 32B slides over support rod 28B and is securely mounted to the chain saw bar 36 as is shown in FIG. 5. Guide fences 40 may be included which operate as before. However, by choosing support rod 28B as the pivot point 18 movable fences are not needed, and all that is necessary is the a permanently installed fence 40 be located as is indicated by arrow 62 a sufficient distance from support rod 28B so that the blade 52 of the chain saw may make a cut completely through work piece 14.

Referring now to FIG. 5, there is shown an example of a guide 32B and support braces 34B suitable for use with the embodiment of this invention illustrated in FIG. 4. As shown in FIG. 5, guide 32B slides smoothly on support rod 28B such as is indicated by arrow 62. Chain saw support brace 34B is securely mounted to guide 32B such as by welding as is shown at 64. A space, such as is indicated by arrow 66, is selected to be large enough to allow the free motion of chain blade 52 without interference. The two portions of brace 34B which are attached to the chain saw both are contoured such that they achieve a distance shown at arrow 68 which is substantially the thickness of the chain saw bar 36. Thus, a bolt 70 may be passed through aperature 72A of chain saw brace 34B and through a matching aperture 72B in the chain saw bar 36. Nut 74 is then used to securely mount the chain saw bar to the brace 34B and guide 32B combination.

Figure 6:
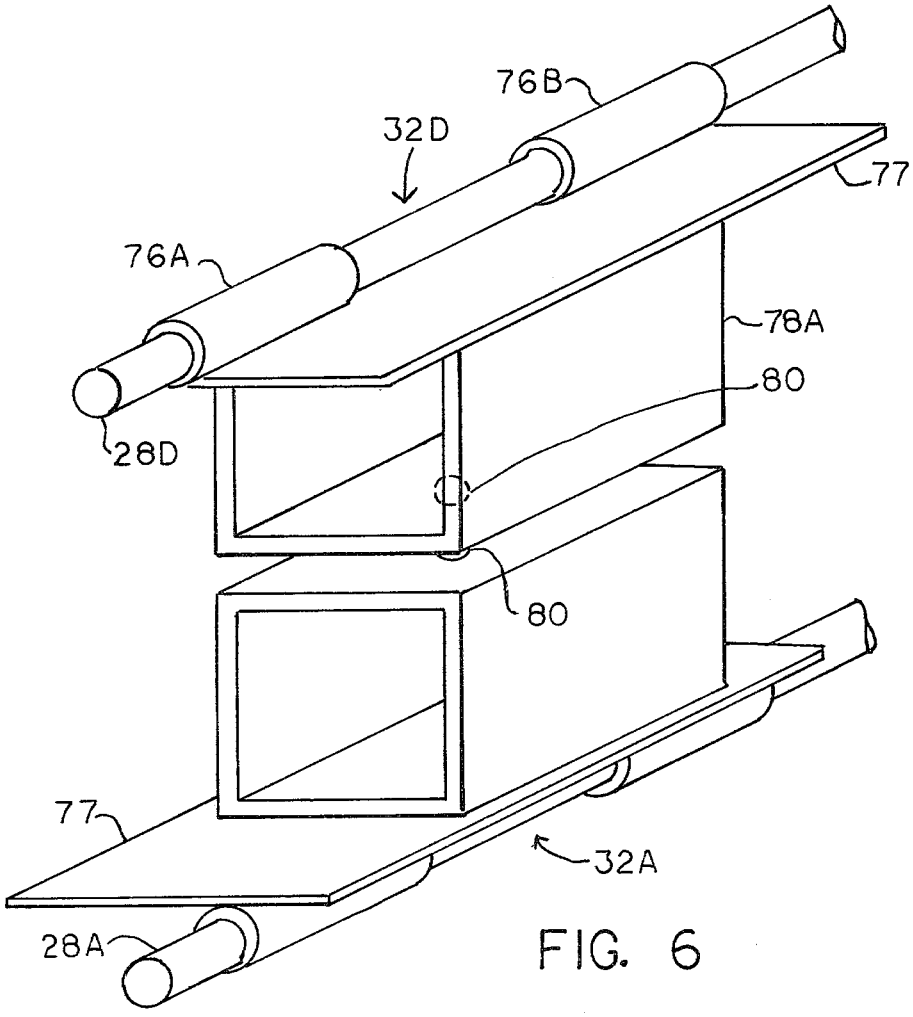
Figure 7:
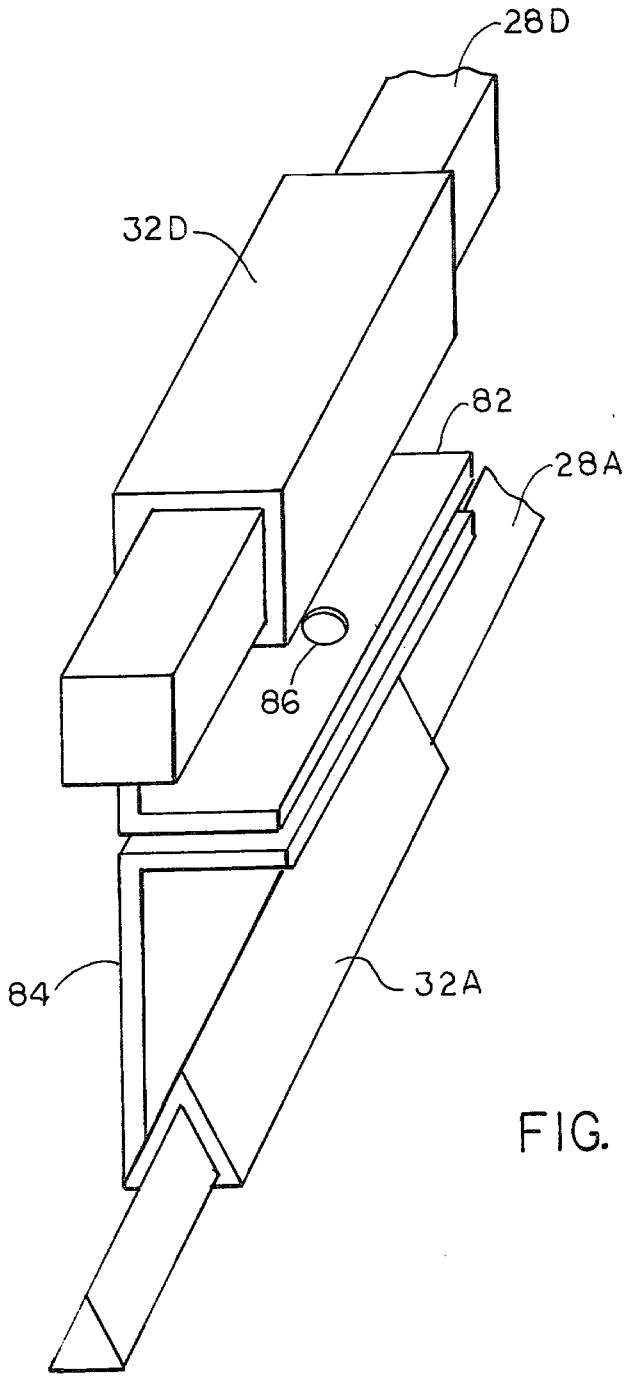

Referring to FIGS. 6 and 7, there is shown a suitable guide and support rod arrangement for the embodiment of FIG. 1 and support rods 28A and 28D of FIG. 4. As is shown in FIG. 6, guide 32 is comprised of two sleeves 76A and 76B to which is welded or securely attached plate 77 and square channel 78. It will be appreciated that plate 77 may be eliminated by simply making square channels 78 longer and welding it directly to sleeves 76A and 76B. A similar arrangement is shown for guide 32A and support rod 28A. Aperature 80 located in the square channels, is used to receive a bolt passing through the apertures in the two channels and through an aperture in the chain saw bar 36. The bolt is then securely tightened to support the chain saw. In a similar manner, there is shown at FIG. 7 two sleeves 32A and 32D. Securely mounted to each, such as by welding, is angle iron 82 and 84. Angle iron 82 and 84 each have an aperture 86 through which a bolt may be passed to securely attach bar 36 of the chain saw. For illustrative purposes only, sleeve 32D is shown as having a square cross section area whereas sleeve 32A is shown as having a triangular cross section. It will be appreciated that the cross section is not important so long as the sleeve and the support rods have matching cross section. It is also important to note that although a square and triangular cross section sleeve is shown in FIG. 7, the angle iron mount may equally be acceptable to a guide which has a circular cross section. Likewise, guide and support rod of FIGS. 5 and 6 could be of a square of triangular cross section rather than a circular cross section.

Thus, although the present has been described with respect to specific apparatus suitable for cutting accurate and precise angles in large work pieces, it is not intended that such specific references be considered limitations upon the scope of the invention except insofar as is set forth in the following claims.

What is claimed is:

1. Apparatus for cutting large work pieces at precise angles comprising:

means for supporting a work piece;

a frame base having a work surface in a plane defined by a first and second axis, said frame base being pivotally mounted to said support means such that when said frame base is rotated around said pivot support and positioned at a selected angle with respect to said support means, said work surface remain in said plane defined by said first and second axis;

a plurality of support members secured to said frame support base and mounted perpendicular to said work surface of said frame base;

a plurality of guide means for moving along each of said plurality of support members;

a plurality of support braces each having a first and further end, said first end permanently secured to said guide means, and said second end suitable for rigidly mounting the bar of a chain saw thereto; and a chain saw having a power source, a cutting chain and a chain saw bar for guiding and supporting said cutting chain, said chain saw bar having a long and a short axis which defines a cutting plane and said chain saw bar being mounted to said support braces such that said long axis of said chain saw bar is substantially parallel to said work surface and said cutting plane is perpendicular to said work surface so that said chain saw is raised and lowered as said guide means move along said support member such that said cutting chain can be moved through said work piece supported by said support means to precisely cut said work piece at said selected angle.

2. The apparatus of claim 1 wherein said support means is a support table.

3. The apparatus of claim 2 and further comprising guide fences for locating said work piece on said support table.

4. The apparatus of claim 1 and further comprising counterbalancing means to aid in moving said chain saw and said guide means along said support members.

5. The apparatus of claim 1 wherein there are four support members and four corresponding guide means.

6. The apparatus of claim 3 wherein said guide fences are adjustable.

7. The apparatus of claim 1 wherein there are three support members and three corresponding guide means.

* * * * *